United States Patent [19]

Voland

[11] 4,146,760

[45] Mar. 27, 1979

[54] LINE SWITCH ASSEMBLY FOR A TIMING MECHANISM

[75] Inventor: Elmo W. Voland, Indianapolis, Ind.

[73] Assignee: P. R. Mallory & Co. Inc., Indianapolis, Ind.

[21] Appl. No.: 827,973

[22] Filed: Aug. 26, 1977

[51] Int. Cl.[2] ..... H01H 43/02

[52] U.S. Cl. ..... 200/38 A; 200/38 B; 200/38 C; 200/153 L

[58] Field of Search ..... 200/153 L, 153 LA, 153 LB, 200/38 A, 38 F, 38 B, 38 BA, 38 C, 38 CA, 153, 38

[56] References Cited

U.S. PATENT DOCUMENTS

| | | | |
|---|---|---|---|
| 3,053,947 | 9/1962 | Bowman et al. | 200/38 C |
| 3,126,759 | 3/1964 | Cook | 200/38 BA X |
| 3,371,170 | 2/1968 | Thomas et al. | 200/38 B |
| 3,596,015 | 7/1971 | Jullien-Davin | 200/38 BA X |
| 3,649,783 | 3/1972 | Voland et al. | 200/38 C |
| 3,819,886 | 6/1974 | Homan et al. | 200/38 B |

*Primary Examiner*—James R. Scott

*Attorney, Agent, or Firm*—Hoffmann, Meyer & Coles

[57] ABSTRACT

A cup shaped hub has an actuator rim at its open end and is rotatably carried on a shaft through an aperture in its closed end. The hub is axially fixed to the shaft such that when the shaft is axially displaced the actuator rim opens and closes a line switch. A ratchet is carried by the shaft and is axially spring biased by a coil spring disposed between the cup shaped hub and the ratchet. A pin carried by the shaft engages the ratchet such that the ratchet may be rotated and axially displaced with the shaft. A coupling means couples the shaft to a cam means rotatably carried by the shaft and the cup shaped hub and includes teeth engaging the ratchet means such that a manual rotation of the shaft provides manual rotation of the cam means.

9 Claims, 3 Drawing Figures

FIG. 1
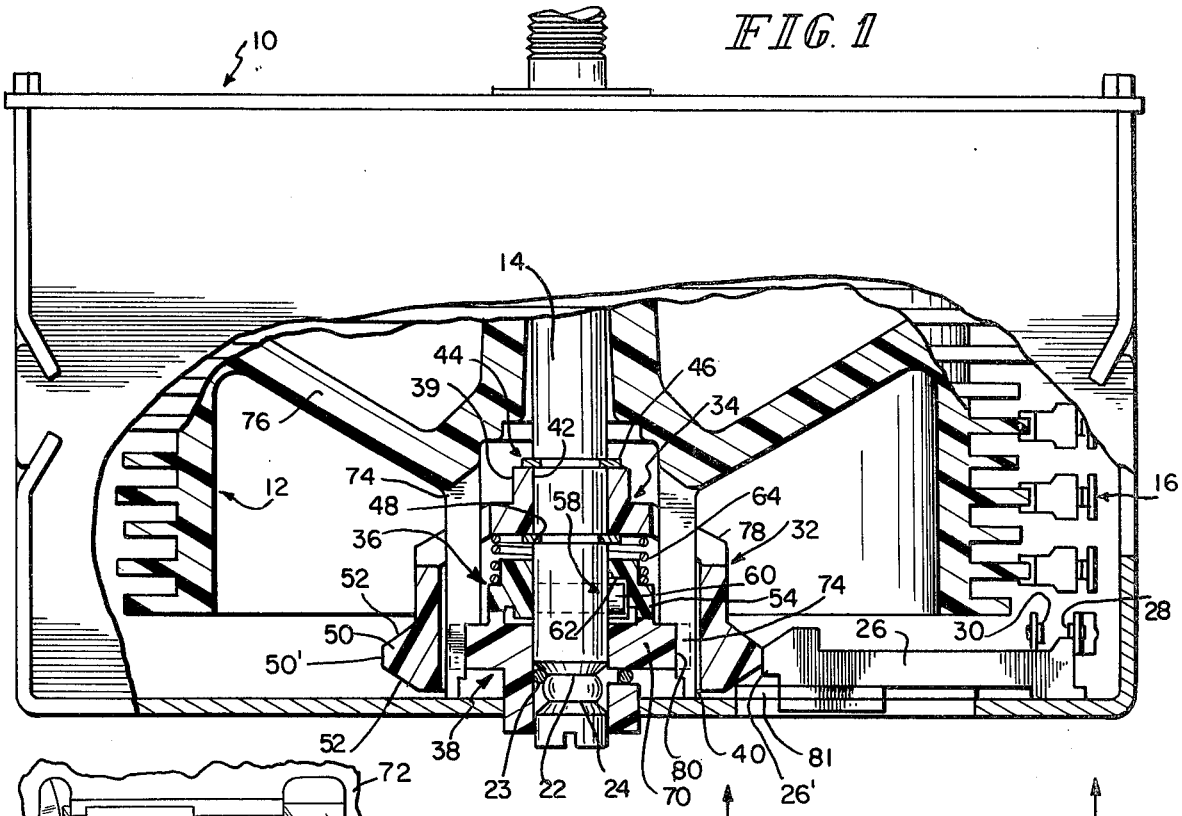
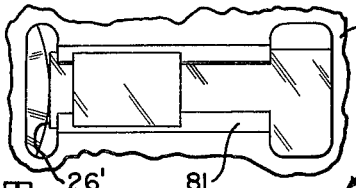
FIG. 3
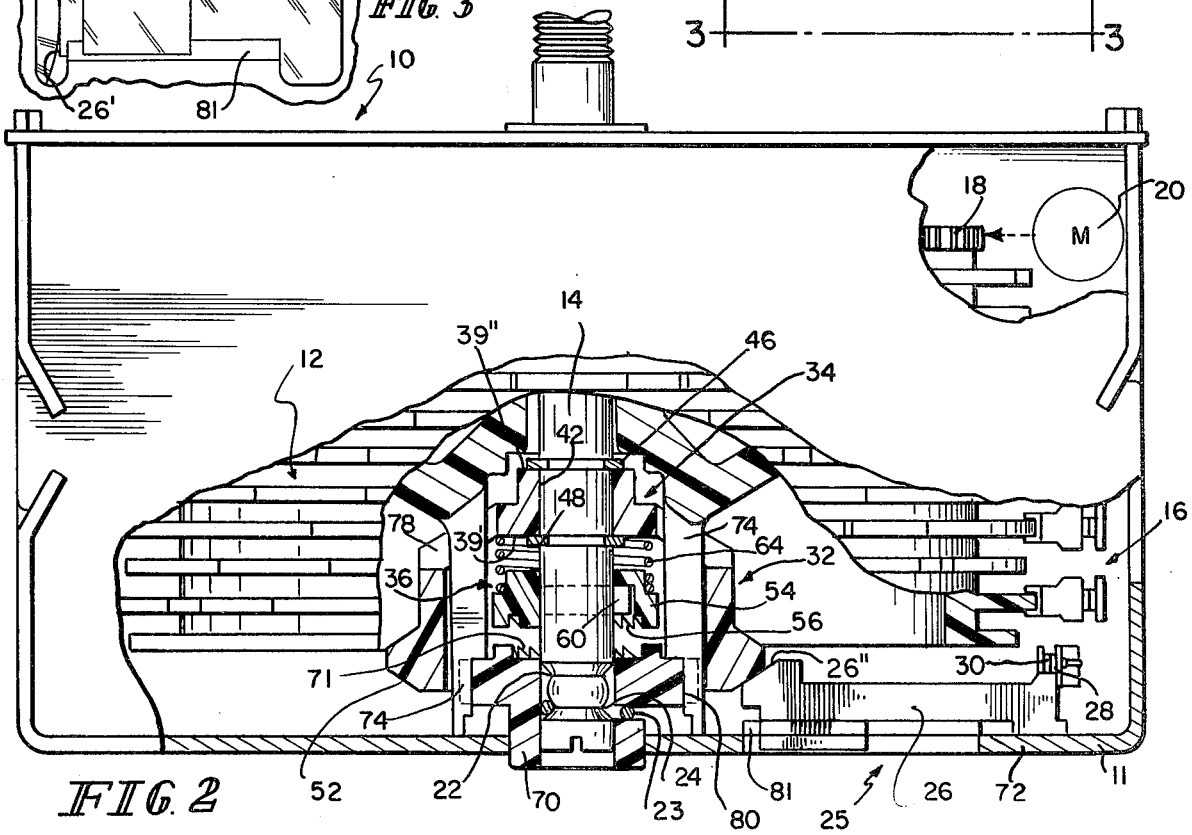
FIG. 2

LINE SWITCH ASSEMBLY FOR A TIMING MECHANISM

BACKGROUND OF THE INVENTION

Generally speaking, the present invention relates to an improvement in a timing mechanism wherein a cam means is rotated about a shaft by power drive means to open and close electrical switches responsive to the cam means, wherein the cam means is manually rotatable independent of the power drive means, and wherein a line switch is opened during such manual rotation to break electrical power to the timing means, the improvement being directed to a means permitting manual rotation of the cam means independent of the power drive means and in addition displacing the line switch to open the same, comprising: line switch actuator means rotatably carried about said shaft including stop means engaging the shaft and preventing axial displacement of the actuator means with respect to the shaft; axially spring biased ratchet means rotatably carried about the shaft; first coupling means engaging the shaft and said axial spring biased ratchet means to provide axial displacement and rotation thereof in accordance with an axial displacement and rotation of the shaft; and second coupling means coupling the shaft to the cam means and to the line switch actuator means including teeth engaging the spring biased ratchet means.

The present invention relates to a timing mechanism and more particularly to a timing mechanism having a line switch actuator assembly.

Timing mechanisms of the type described herein have long been used to control the operation of appliances such as washing machines, dish washing machines, and dryers. In such devices a cam means rotates about a shaft through power driven rotation to open and close electrical switches to complete electric circuits to the functions of the appliance. In timing mechanisms such as these the cam means can usually be manually rotated independently of the power drive means such that the operator of the appliance can manually set the start of a desired program. A line switch is usually provided such that during the manual rotation, electric power to the timing mechanism is broken. Without such breaking of power to the timing mechanism, the electrical contacts would be severely burned during such rotation causing damage to the switch contacts.

FEATURES OR OBJECTS OF THE INVENTION

The present invention is concerned with a line switch actuator assembly which, during manual rotation of the timing mechanism shaft, opens a line switch and in addition permits the shaft to be independently rotated from the power drive means and has as one of its features the provision of such an assembly which is simple and economical to produce. Another feature of the invention is the provision of such an assembly wherein a line switch actuator means is rotatably carried about a shaft and includes a stop means preventing axial displacement of the actuator with respect to the shaft. Another feature of the invention is the provision of such an assembly wherein the line switch actuator means includes a cup shaped hub having an open end and an aperture in its closed end for receiving the shaft and an actuator rim at its open end. Another feature of the invention is the provision of such an assembly wherein the actuator rim includes a ramped surface engaging a movable contact blade to open or close a line switch.

Another feature of the invention is the provision of such an assembly wherein a ratchet means is carried by the shaft and is spring biased by a coil spring disposed between the ratchet means and the line switch actuator. Still another feature of the invention is the provision of such an assembly wherein a coupling means couples the ratchet means to the shaft to be rotatable and axially displaceable therewith. Yet another feature of the invention is the provision of such an assembly having a coupling means coupling the shaft to the cam means and the line switch actuator means and which includes teeth engaging the spring biased ratchet means. Yet another feature of the invention is the provision of such an assembly wherein the spring biased ratchet means is carried by the shaft through a pin carried by the shaft whereby the ratchet means can be rotated with the shaft and be axially displaced a predetermined amount when the shaft is axially displaced. These and other features of the invention will become apparent from the following description taken in conjunction with the accompanying drawings.

DESCRIPTION OF THE DRAWINGS

FIG. 1 is a front elevation of a timing mechanism with portions thereof broken away showing the features of the invention.

FIG. 2 is a view similar to FIG. 1 illustrating a different operating condition of the timing mechanism.

FIG. 3 is a view taken along the line 3—3 of FIG. 1.

DETAILED DESCRIPTION

Referring now to the drawings, timing mechanism 10 in general includes a cam means 12 rotatably carried about a shaft 14, and electrical switches 16 which engage the cam means to be opened and closed in accordance with its program. Cam means 12 also includes a gear or ratchet 18 which is constructed integrally therewith. Gear 18 is coupled to a power drive means 20 such as a synchronous motor so that the cam means 12 may be rotated about the shaft by the motor. Shaft 14 may be manually axially displaced to one of two positions determined by detents 22 and 24 provided in the shaft 14 and which cooperate with spring detent 23 to hold the shaft in one of two positions. A line switch 25 is opened or closed to connect or disconnect electrical power to the timing mechanism and includes movable slider 26 carrying an electrical contact 28 and fixed contact 30. Line switch 25 may be opened and closed by opening and closing electrical contacts 28 and 30 through slider 26 to make or break electrical power through the timing mechanism. Such opening and closing of the electrical contacts 28 and 29 by the slider 26 is accomplished through line switch actuator assembly 32.

Line switch actuator assembly 32 includes a line switch actuator means 34, spring biased ratchet means 36, and coupling means 38 which couples the shaft to the cam means 12 and to the line switch actuator means 34.

Line switch actuator means 34 includes a cup shaped hub member 39 having an open end 40 and an aperture 42 in its closed end through which shaft 14 is extended. The cup shaped hub member 39 is freely rotatable about the shaft but is axially fixed thereon through retaining means 44. Retaining means 44 includes a pair of rings 46 and 48 fixedly carried by the shaft and engaging inner and outer surfaces 39' and 39'', respectively (FIG. 2) of the cup shaped hub 39. Disposed at the open end 40 of the cup shaped hub is an actuator rim 50 having a ramped surface 52 engaging ramp 26' of slider 26.

Ratchet means 36 includes a ring 54 carried about the shaft 14 and having ratchet teeth 56 carried on a face thereof. The ring 54 is rotatable about the shaft 14 and is axially displaceable with the shaft by coupling means 58. Coupling means 58 includes a pin 60 carried in the shaft 14 and engaging an over sized slot or opening 62 provided in the ring 54. The ring is axially spring biased through coil spring 64 disposed between the ring and the inner surface 39' of the cup shaped hub 39.

Coupling means 38 includes a bushing 70 having teeth 71 and which is rotatably journalled in a plate 72 of a housing 11 for the timing mechanism and a plurality of fingers 74 extending from a hub 76 of cam means 12. As shown, the fingers 74 extend through slots 78 provided in cup shaped hub 39 and engage slots 80 provided in bushing 70. Consequently, when bushing 70 is rotated, hub 39 and cam means 12 are rotated.

In operation and with reference to FIG. 1, the line switch actuator assembly 32 is in an operating mode wherein the cam means 12 may be set manually by the appliance operator. More specifically, shaft 14 has been indexed "in" to engage teeth ratchet teeth 56 with teeth 71 of bushing 70. Such engagement is accomplished by the axial displacement of line switch actuator 34 to axially displace ring 54 through coil spring 64 which permits the teeth to become engaged even though the teeth may not be aligned tip to tip. Slider 26 has been biased to the position shown to open contacts 28 and 30 through cooperating surface 26' and 50', the slider 26 being slideable in slot 81 provided in plate 72 (FIG. 3). Manual rotation of shaft 14 causes rotation of ring 54 through pin 60 which in turn causes rotation of bushing 70 to rotate cam means 12.

In the operating mode of FIG. 2, shaft 14 has been indexed "out". Ring 54 has been displaced through pin 60 to disengage teeth 56 and 71. Line switch actuator 34 has been axially displaced to permit slider 26, through the cooperation of ramps 26'' and 52, to move to the position shown to close contacts 28 and 30. Cam means 12 is now rotated through motor 20 and gear 18.

What is claimed is:

1. In a timing mechanism wherein a cam means is rotated about a shaft by power drive means to open and close electrical switches responsive to said cam means, wherein said cam means is manually rotatable independent of said power drive means, and wherein a line switch is opened during such manual rotation to break electrical power to said timing means, a mechanism permitting manual rotation of said cam means independent of said power drive means and displacing said line switch to open same comprising:

(a) line switch actuator means rotatably carried about said shaft including retaining means carried by said shaft and preventing axial displacement of said line switch actuator means with respect to said shaft, (b) axially spring biased ratchet means rotatably carried about said shaft, (c) first coupling means coupling said shaft to said axially spring biased ratchet means to provide rotation and axial displacement thereof in accordance with a rotation and axial displacement of said shaft, and (d) second coupling means coupling said shaft to said cam means and said line switch actuator means, including teeth engaging said spring biased ratchet means.

2. In a timing mechanism according to claim 1 wherein said line switch actuator means includes a cup shaped hub having an open end, an aperture in its closed end for receiving said shaft, and an actuator rim at said open end.

3. In a timing mechanism according to claim 2 wherein said actuator rim includes a ramped surface engaging said line switch.

4. In a timing mechanism according to claim 2 wherein said first coupling means includes a pair of rings carried by said shaft and engaging inner and outer surfaces of said cup shaped hub.

5. In a timing mechanism according to claim 1 wherein said axially spring biased ratchet means includes a ring having ratchet teeth carried on a surface thereof and said first coupling means includes a pin carried by said shaft and engaging an opening in said ring, said opening being of greater size than said pin.

6. In a timing mechanism according to claim 5 wherein said axially spring biased ratchet means is biased by a coil spring surrounding said shaft compressed between said line switch actuator means and said ring.

7. In a timing mechanism according to claim 1 wherein said second coupling means includes a bushing rotatably carried by said shaft, slots in said bushing receiving fingers extending from a hub of said cam means, and slots in said line switch actuator means receiving said fingers.

8. In a timing mechanism according to claim 7 wherein said bushing is carried by said shaft by a spring detent engaging said bushing and a detent in said shaft.

9. In a timing mechanism according to claim 8 wherein there are two spaced detents in said shaft, said spring detent engaging alternate over thereof to thereby determine the amount of axial displacement of said shaft.

* * * * *